United States Patent [19]

Timson

[11] 4,155,133

[45] May 22, 1979

[54] BOOKMAKING

[75] Inventor: Ernest A. Timson, Kettering, England

[73] Assignee: Timsons Limited, Kettering, England

[21] Appl. No.: 802,667

[22] Filed: Jun. 2, 1977

[30] Foreign Application Priority Data

Mar. 16, 1977 [GB] United Kingdom ..... 51558/77
Apr. 19, 1977 [GB] United Kingdom ..... 16180/77

[51] Int. Cl.[2] ..... B42C 19/08
[52] U.S. Cl. ..... 11/1 R; 198/374; 198/403; 414/763; 414/768
[58] Field of Search ..... 11/1 R; 214/1 Q; 198/374, 402, 403

[56] References Cited

U.S. PATENT DOCUMENTS

| | | | |
|---|---|---|---|
| 2,667,259 | 1/1954 | Parker | 198/403 X |
| 3,485,387 | 12/1969 | Sickinger et al. | 214/1Q |
| 3,501,036 | 3/1970 | Calistrat | 198/374 X |
| 3,595,370 | 7/1971 | Fujishiro | 198/374 |
| 3,826,290 | 7/1974 | Pfaffle | 198/374 X |
| 3,948,385 | 4/1976 | Shinomiya et al. | 198/403 |

*Primary Examiner*—Meister, J. M.
*Attorney, Agent, or Firm*—Merriam, Marshall & Bicknell

[57] ABSTRACT

Method of, and apparatus for, making books using the two-up, coming and going method in which halfblocks, two of which form a double book block, are moved in a single stream, alternate halfblocks being turned through 180° as they move and the halfblocks being collated in pairs each pair containing a turned and an unturned halfblock.

15 Claims, 6 Drawing Figures

BOOKMAKING

BACKGROUND OF THE INVENTION

1. Field of the Invention

This invention relates to the conveying and turning over of batches of sheets of paper during the making of books. The invention is useful, inter alia, in 2-up coming and going methods of bookmaking. The term "book" is used herein to mean any assembly of pages arranged in a required order and to include not only printed books but, for example, diaries and any collection of printed sheets arranged in a required order.

2. Description of the Prior Art

Bookmaking using the 2-up coming and going method involves making two books or book sections at once from a paper web which has been printed so that each successive length of the web shows a number of pages each of which appears only once, the pages being printed in such positions that, after slitting, cutting, if necessary folding, and collating a half-block is formed which has two sequences of pages. This half-block contains all the pages, hereinafter referred to as the primary pages, of the book or book section which have been printed on the web. Each side of each leaf of the half-block shows two pages arranged in side-by-side, head-to-head or tail-to-tail relationship, one page being from one sequence and the other page being from the other sequence. Each sequence contains half the primary pages of the book or section, one sequence containing the primary pages of the first half of the book or section in proper order and the other sequence containing the primary pages of the second half of the book or section in proper order. If one considers the order of the primary pages in each sequence with respect to one face of the half-block then the primary pages in one sequence "go" from that face while the primary faces in the other sequence "come" to that face.

Two of these half-blocks are superposed in appropriate relation to make a block containing all the pages of two books arranged side by side. The block will then be bound and separated into two books.

In addition to the primary pages, a half-block may also include secondary or inserted pages such as drawings, photographs or title pages which are not printed in the same operation as the printing of the web referred to above. These inserted pages may, for example, be fed into the half-block during collating of the pages. Alternatively, the inserted pages may be grouped together in a separately printed insert section which may be fed between two half-blocks when the half-blocks are combined to form a block as described above, may be added to one of the half-blocks before the half-blocks are combined, or may be fed onto the top or bottom of the block after the half-blocks have been combined.

Two book sections can also be made at once using the 2-up coming and going method described above. In this instance a block will be formed which is a double book section and which can be separated into two book sections each of which will have all the required pages of the section.

The above double book section block can be combined, prior to separation, with other double section blocks printed using the 2-up coming and going method to produce a larger block which can be bound and then separated into two complete books.

One object of the invention is to provide a simple method of, and apparatus for, conveying, turning over and, if desired, combining batches of paper during the making of books and which are particularly, but not exclusively, useful in 2-up coming and going bookmaking in which the batches will be the half-blocks referred to above.

SUMMARY OF THE INVENTION

According to one aspect of the invention I provide a method of making a book from batches of leaves of paper each having printed thereon two pages meeting in a junction; the method including the steps (1) of conveying the batches one behind the other in a single stream and (2) while the batches are being so conveyed turning selected ones of said batches through 180° about an axis parallel to the junctions between the pages of the batch.

The method is extremely simple since the turning action takes place on only a single stream of batches as they move.

Each alternate batch may be turned over. The method may include combining the turned and unturned batches in pairs, each pair comprising a turned batch and an unturned batch. This procedure will be used if the batches are half-blocks for 2-up coming and going bookmaking. Preferably the batches are turned over about a horizontal axis and the combining takes place by placing the batches in superposed relation.

The batches may be conveyed along a pair of conveyors which are spaced apart in end to end relation, the selected batches being turned as they move from one conveyor to the other, the other batches passing from one conveyor to the other without turning. In this method, the leading end portion of each selected batch may be tipped so as to move between the conveyor ends while the part of the conveyor upstream of said ends continues to feed the batch forwardly so that the batch turns over through 180°. The batches may be travelling, before they are turned with a downward inclination which assists in the turn over of the batches.

Alternatively the batches may be conveyed in spaced relation, one behind the other, and at the same speed, the method comprising moving into at least some of the spaces between the batch grippers therefor, the grippers moving at the same speed, in the same direction and along the same path as the batches, accelerating each of said batches which is immediately behind a gripper so that the batch enters the gripper which is held open, closing each gripper when a batch has entered it, turning each batch while so gripped and then releasing the turned batches.

According to this aspect of the invention more narrowly considered I provide a method of assembling a block for a double book or double book section in a 2-up coming and going method of bookmaking in which successive lengths of a paper web have each been identically printed so that each length shows in total a number of primary book pages each of which appears once only, the method of assembling comprising (1) providing a plurality of identical batches of signatures, each batch consisting of leaves of paper formed by cutting and slitting one of said lengths and containing all of said primary pages arranged in pairs on the leaves with each pair of pages meeting in a junction; (2) conveying the batches in a single stream one behind the other towards a combining station; (3) while the batches are being so conveyed turning each alternate batch of the stream through 180° about an axis parallel to the junctions of the pages in the batch; and (4) assembling the batches at the combining station in pairs to form blocks for a double book or a double book-section, each such pair comprising a batch which has been turned and a batch which has not been turned.

According to another aspect of the invention I provide apparatus for conveying and turning batches of leaves of paper, the apparatus comprising means for conveying the batches in a single stream one behind the other and means to turn selected batches of the stream through 180° during their conveyance in the stream.

Preferably the apparatus includes a combining station and assembling means at the combining station to assemble the turned and unturned batches in a desired combination.

The conveying means may be a pair of conveyors which are spaced apart in end-to-end relation and the turning means may be located adjacent the adjacent ends of the conveyors so that each selected batch is turned by the turning means as the batch moves from one conveyor to the other.

Preferably, the turning means is arranged to engage the leading end portion of each selected batch to cause said end portion to move between the conveyors and so that the trailing end portion of the batch continues to travel forwardly. The turning means may also include a rotatable member to lift the trailing end portions of the selected batches while the leading end portions are at the adjacent ends of the conveyors. The conveyor means are preferably in the form of tape transport systems.

Alternatively in the apparatus said conveying means may comprise a first conveying means for conveying said batches in spaced relation one behind the other, and the apparatus may include second conveying means carrying grippers for the batches, means co-relating the actions of the first and second conveying means so that the grippers enter the spaces between at least some of the adjacent pairs of batches as the latter are moved by the first conveying means, the grippers being moved at the same speed and in the same direction as the batches, means for accelerating those batches which lie immediately behind the grippers into engagement with the grippers, means for opening and closing the grippers and arranged to operate so that the grippers are open when the batches are accelerated into engagement with the grippers and are then closed to grip the engaged batch, means for turning the grippers as they are moved by the second conveying means, and means to open the grippers to release the turned batches.

If one is using the apparatus in the 2-up coming and going method of bookmaking then the grippers will be arranged to grip each alternate batch of the batches being moved by the first conveying means and will turn this batch through 180° so that one will end with a single stream of turned and unturned batches.

BRIEF DESCRIPTION OF THE DRAWINGS

The invention will now be described in detail by way of example with reference to the accompanying drawings in which.

DESCRIPTION OF THE PREFERRED EMBODIMENTS

The principles of 2-up coming and going bookmaking will first be explained briefly with reference to FIGS. 1 and 2 and with reference to the manufacture of a book consisting of 192 primary pages.

Figure 1:
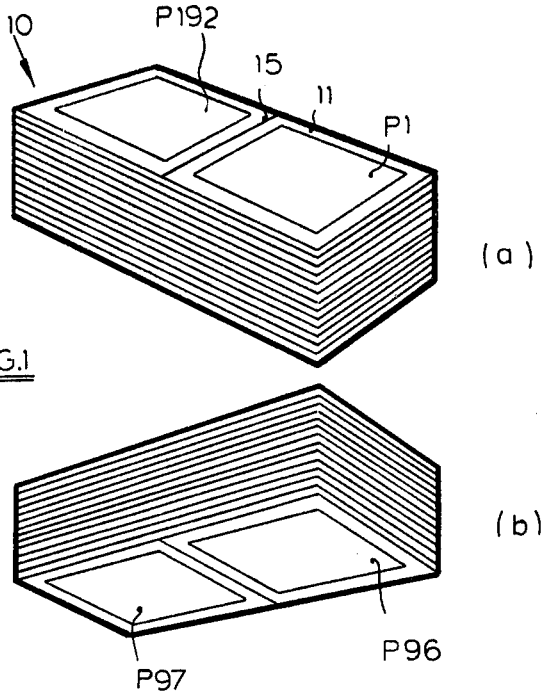
FIGS. 1(*a*) and 1(*b*) show a half-block for a double book and show the upper and lower faces thereof respectively.

Referring first to FIG. 1, this shows a half block 10 for a double book used in the manufacture of two 192 page books. Each leaf of the half-block shows, on each side, two pages which are arranged side-by-side, head-to-head or tail-to-tail. One terminal leaf, namely the upper leaf 11 of the half-block shown in FIG. 1(*a*) shows pages 1 and 192 indicated by P1 and P192 at its exposed side, said pages being. The other terminal leaf at the lower face of the half-block shown in FIG. 1(*b*) shows pages 96 and 97 at its exposed side indicated by P96 and P97. There are two page sequences through the half book block, thus there is the right-hand page sequence which goes from page 1 to page 96 and there is the left-hand sequence of pages which comes from pages 97 to 192. The "going" and "coming" is with reference to the face of the half-block at which the leaf 11 is situated. Each leaf is printed on each side thereof.

Figure 2:
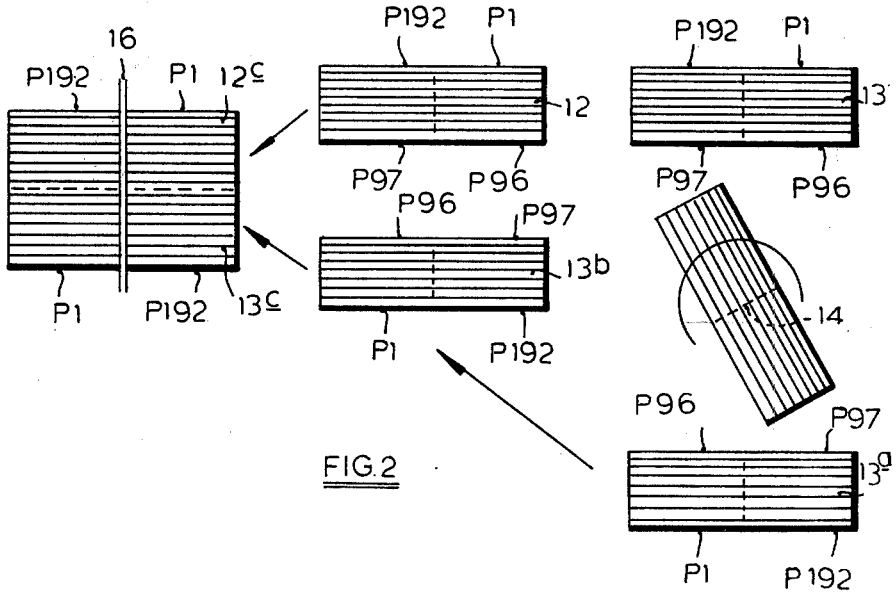
FIG. 2 is a diagram illustrating how two identical half blocks can be placed together to form a block from which two books can be made.

FIG. 2 shows two half-blocks identical to that shown in FIG. 1, the half-blocks being indicated at 12 and 13 and the numbers of the pages shown at opposite faces of the half-block being indicated. The two half-blocks are shown side by side at the top of the figure with the terminal leaves bearing the highest and lowest page numbers facing upwardly and the terminal leaves bearing the intermediate consecutive page numbers facing downwardly and with the pages of one half block in the same orientation as those of the other half block. The half-block 13 is now turned through 180° about an axis 14 which is parallel to the planes of the leaves and to the junction 15, shown in FIG. 1, between the two pages shown on each leaf of the half-block. The half-block 13 is shown after having completed its turn at 13*a*. Pages 96 and 97 are now shown at the upper face of the half-block and are reversed, left to right, with respect to their positions with the half-block in the position 13. Thus at 13*a* page 96 is to the left and page 97 is to the right whereas when the half-block is in the position shown at 13, page 97 is to the left and page 96 to the right. The half-block 13 can now be moved to a position such as shown at 13*b* in which it lies under the half-block 12 and it will be seen that the page 96 of the half-block 13 lies under page 97 of the half-block 12 while page 97 of the half-block 13 lies under page 96 of the half-block 12. Thus when the two half-blocks are placed together as shown at 12*c* and 13*c* one has a block for a double book. On the right-hand side the pages "go" downwardly from 1 to 192 while on the left-hand side the pages "come" upwardly from page 1 to page 192. The block can now be cut as indicated at 16 to form two books. Normally, the block will be bound before being cut into the separate books.

It will be seen from the foregoing explanation with reference to the diagrammatic illustrations of FIGS. 1 and 2 that it is necessary to turn one of the half-blocks forming the block for a double book through 180° with respect to the other half-block and then to superimpose the two half-blocks so as to get the whole series of pages coming at one side of the block and going at the other. The invention is concerned, inter alia, with a method of and an apparatus for turning and putting together the half-blocks from which double books or double book sections are formed.

Figure 3:
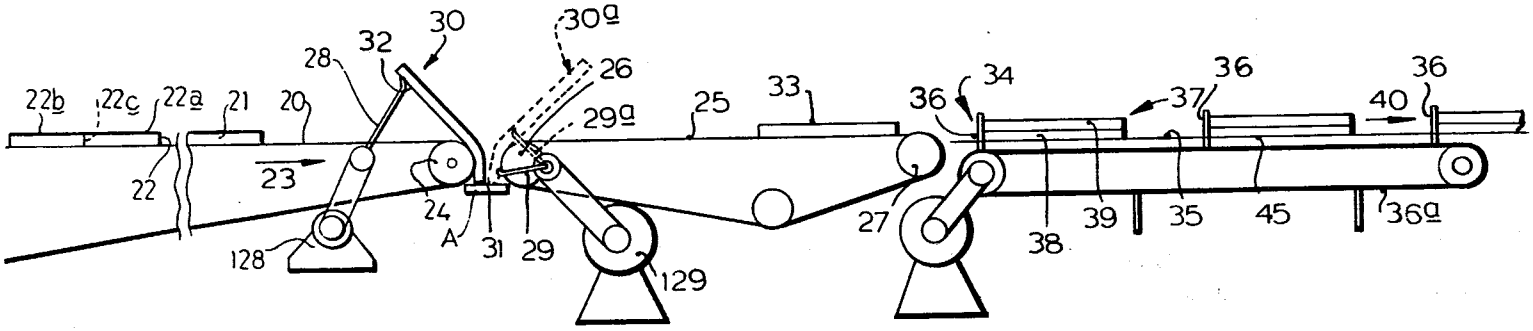
FIG. 3 is a diagrammatic view in side elevation of a first embodiment of apparatus in accordance with the invention for carrying out the method of the invention.

Referring now to FIG. 3, there is first conveying means indicated at 20 in the form of a tape conveying system. Shown on this conveying means are two half-blocks 21 and 22 one behind the other. The half-blocks are identical as described in relation to FIGS. 1 and 2 and each contains all the primary pages of the book or book section which is to be made. In the manufacture, for example, of a book having 192 pages, the leading part of each half-block, for example the leading part **22*a* of the half-block 22, will contain the pages 1 to 96, page 1 being at the top of the half-block and page 96 at the bottom of the half-block while the trailing portion 22*b* will contain pages 97 to 192, page 97 being at the bottom of the half-block and page 192** being at the top.

The conveying means 20 is operated to move the half-blocks one behind the other in a single stream in the direction of the arrow 23. The tapes of the conveyor system pass over a series of laterally spaced end rollers 24. A further conveying means is indicated at 25 and is also in the form of a tape system having a series of laterally spaced end rollers 26 and 27. The conveyors 20 and 25 are aligned with one another but there is a gap between them, i.e. between the roller series 24 and 26.

Upstream of the rollers 24 are mounted rotary fingers 28 which project between the tapes of the conveyor 20 and which are rotated by means 128. Pivoted fingers 29 are associated with the roller series 26, the individual fingers being located between adjacent rollers of the series. Means 129 is provided for rotating the fingers 29. Instead of the fingers being rotated they may be oscillated about their pivots by cam mechanism, not shown. Below the gap between the rollers 24 and 26 there may be provided, as shown in FIG. 3, an abutment A.

The fingers 29 are so moved that each alternate half-block has its leading edge diverted downwardly by the fingers 29 when they are in the position **29*a*, simultaneously the trailing end of the half-block is lifted by the fingers 28. Such a half-block is shown at 30 with its leading end portion 31 having moved downwardly between the adjacent conveyor ends and into engagement with the abutment A. The trailing end portion 32 of the half-block 30 is engaged by the fingers 28 while the intermediate portion of the half-block will engage the conveyor 20 and will continue to move to the right in FIG. 3 so that the half-block will turn over as indicated at 30*a*. The half-block will now be picked up by the conveyor 25 and moved to the right behind a further identical half-block 33 which is already on the conveyor 25 but which has not been turned over. The half-block 33 has not been turned over because the rotation of the fingers 28 and 29 is timed to turn over only alternate half-blocks, the other alternate half-blocks passing between the conveyors without being turned because the fingers 28 and 29 are below the upper runs of the conveyors. The half-block 30 has been turned over about a horizontal axis which is parallel to the junction such as 15 in FIG. 1 between the pages in the half-block, such a junction being indicated at 22*c* for the half-block 22**.

Thus arriving on the conveyor 25 are alternate half-blocks such as 30 which has been turned over and alternate half-blocks 33 which have not been turned over.

A combining station is indicated at 34 and comprises a slotted receiving table 35 through the slots of which extend pushers 36 mounted on a driven endless belt **36*a*. The table 35 is at a lower level than the conveyor 25 so that two successive half-blocks can be dropped from the conveyor 25 one above the other onto the table 35 to form a block for a double book or a double book section. Thus, for example, the double book block or section 37 comprises a half-block 38 which has been turned over and a half-block 39 which has not been turned over. The double book block or section is then moved by pushers 36, in the direction of the arrow 40, to be bound or, if a book section has been made, to be put together with other book sections. The rotation of the belt 36*a* is timed to bring a pusher 36 into position to remove a block such as 37 after two half-blocks have been deposited on the table 35**.

The table 35 and pushers 36 may be replaced by a tape conveyor if the movement of the assembled blocks is not critical.

Figure 5:
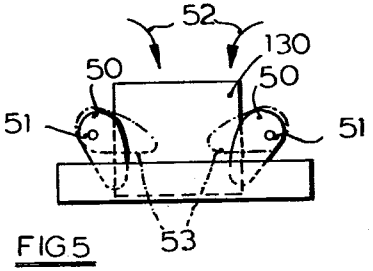
FIGS. 4 and 5 are diagrammatic views in side elevation of a second embodiment of apparatus in accordance with the invention for carrying out the method thereof.
Figure 4:
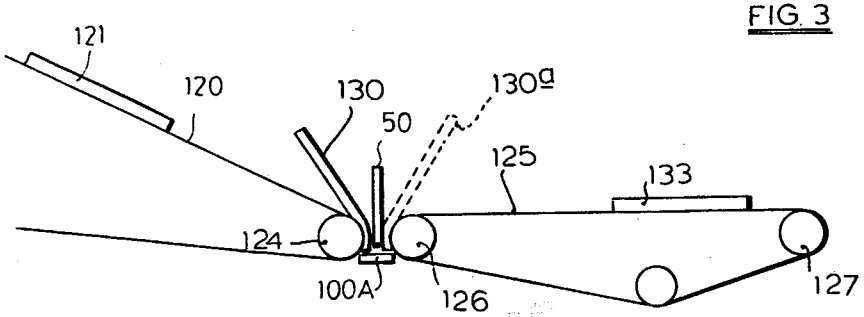

Referring now to FIGS. 4 and 5, these show a second embodiment of the invention which is similar to the embodiment shown in FIG. 3 except that (1) the fingers 29 of FIG. 3 which rotate about an axis transverse to the direction of movement of the half-blocks are replaced by two quadrants which are rotated about axes parallel to the direction of movement of the half-blocks and; (2) the upstream conveyor is inclined downwardly and the fingers 28 omitted. Parts in FIGS. 4 and 5 which are identical with those in FIG. 3 are indicated by the same reference numeral with the prefix 1. Referring to FIGS. 4 and 5 a half-block 130 is being turned between the end rollers 124 and 126 of the conveyors 120 and 125. The turning has been effected by two quadrants 50 arranged one on either side of the path of the half-blocks and rotatable about axes 51 parallel to the direction of movement of the half-blocks along the conveyors. The quadrants rotate in the directions of the arrows 52 in FIG. 5 and their ends 53 engage the leading end portion of a half-block approaching the gap between the conveyors and move this down into the gap between the conveyors as shown for the block 130 so that as the quadrants complete their rotation and come entirely out of the path of the half-blocks the half-blocks can move over to the position at **130*a* and then be picked up on the conveyor 125**.

A feature of the arrangement of FIGS. 4 and 5 is that the quadrants are, when not in use, entirely out of the path of the half-blocks and the downward inclination of the conveyor 120 assists in turning over the half-blocks. The operation of the embodiment of FIGS. 4 and 5 is otherwise similar to the operation of FIG. 3.

In FIG. 3 the conveyor has been shown conveying the half-blocks horizontally but it could be inclined downwardly so as to convey the batches with a downward component of movement towards the turning means as in FIGS. 4 and 5. Such downward inclination assists in turning over the batches, especially if they are of flimsy paper.

Figure 6:
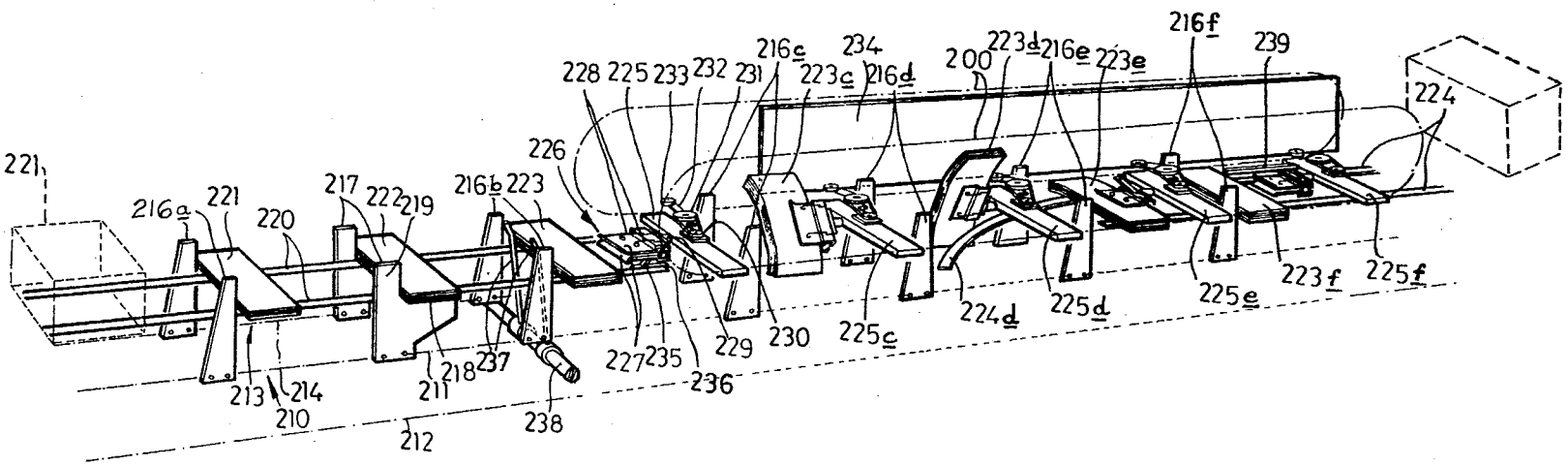
FIG. 6 is a perspective diagrammatic view of a third embodiment of apparatus in accordance with the invention for carrying out the method thereof.

Referring now to FIG. 6, the embodiment there shown comprises first conveying means in the form of a pair of endless chains with their upper and lower runs horizontal. One of the chains is indicated at 210 and has an upper run 211 and a lower run 212. The other chain is indicated at 213 and only the upper run 214 is shown. Each chain carries pushers and combined pushers and supporting elements. Thus a first pair of pushers forming a set is indicated at 216*a* and a second set of pushers at 216*b*, the pushers extend at right angles to the chains and the pushers of each pair are aligned with one another. The sets of pushers are spaced apart at equal intervals along the chains 210 and 213. Only two sets of pushers 216*a*, *216b* are shown in the drawing, but one pusher of remaining sets 216*c*, 216*d*, 216*e*, 216*f* are also shown.

Between each set of pushers is a set of combined pushing and supporting elements, one such set comprising a pair of the elements being indicated at 217. Each of the elements 217 has a horizontal supporting part 218 and a vertical pushing part 219. Only one set of combined pushing and supporting elements is shown in the drawing but in practice there is a set of such elements between successive sets of pushers such as 215*a* and 216*b*.

Above the upper runs 211 and 214 of the chains is a support in the form of a pair of rails 220 which are horizontal.

The rails 220 lie between the pushers of each set such as 216*a* and between the combined pushing and supporting elements 217 of each set. At their left-hand ends the rails extend into a collating unit indicated diagrammatically at 221. In this collating unit are collated the required number of signatures. It will be assumed in the following description that the apparatus is being used for making a book containing 256 pages by the 2-up coming and going method described above. It will be further assumed that this book will be made from eight signatures each containing thirty-two pages. In the collating unit will be collated sets of four signatures. The four signatures of a set will contain all the pages of the book. Each leaf of each signature will contain two pages of the book arranged, for example, in head-to-head relationship and the pages will constitute two sequences. The pages of one sequence will "go" from the upper surface of the collated signatures from page 1 to page 127 and the other sequence will "come" from the underface of the collated pile of signatures from page 128 to page 256. Two of these batches of signatures will be put together as will be described below after one of them has been turned about an axis parallel to the planes of the leaves and to the junction between the pages on each leaf.

The pushers 216*a* to 216*f* and combined pushing and supporting elements 217 are arranged to go through the collating unit, each to pick up a batch of four signatures. Thus the set of pushers 216*a* are shown as pushing, along the rails 220, a batch 221 of four signatures. The combined pushing and supporting elements 217 are shown as carrying a second batch 222 of four signatures. The batch of signatures 221 is resting on the rails 220 and the batch of signatures 222 is resting on the horizontal supporting parts 218 which are co-planar with the rails and are being pushed along by the pushing parts 219. The set of pushers 216*b* are pushing along the rails 220 a further batch 223 of four signatures.

The apparatus is arranged to receive each of the batches being pushed along the rails by the sets of pushers such as 216*a* and 216*b* and to turn these batches through 180° about an axis which is horizontal and which extends in the direction of conveying movement of the batches. The batches carried by the combined supporting and pushing elements such as 217 will not be turned. At the right-hand end of the chain run, the batches are collected into pairs, each pair comprising a turned batch and an unturned batch.

The right-hand part of FIG. 6 shows a sequence of positions for the pushers 216 and the batch 223 as the latter is turned through 180° and, after turning, is deposited once more upon a support at the right-hand end of the chain run, the support consisting of a pair of rails 224.

The turning of the batches is carried out by grippers which are carried by a second pair of endless chains which are indicated at 200. These chains 200 are arranged above the chains 210, 213 and the upper and lower runs of the chains 200 are parallel to the upper and lower runs of the chains 210 and 213. Extending between the chains 200 at spaced intervals are cross members, one of which is indicated at 225. Each cross member carries a gripper 226 which comprises two plates 227 which are urged to a closed position by hairpin springs 228. Each gripper is mounted on a horizontal shaft 229 which is connected to gearing (not shown) within the cross member. The gearing is drivable from a chain sprocket 230 which is connected by a chain to a further sprocket 231 which carries an arm 232 having a roller 233 at the end thereof. As the cross member moves to the right in FIG. 6, the roller 233 engages a cam member 234 which is set at an angle to the chain runs and is arranged so that, as the roller 233 runs along the cam surface, it turns the sprocket 231 and thus the sprocket 230, thus turning the grippers 226 through 180° as will be described in more detail below.

Each gripper has an operating arm 235 which is arranged to engage a cam 236 which is fixed in position relative to the machine. When the gripper is in the position shown at 226 at the left-hand end of the chain runs 200, the operating arm 235 engages the cam 236 and opens the gripper against the action of the springs 228. It will be noted that the gripper lies between the support constituted by the rails 220 and that the rails terminate adjacent to the position of the gripper shown at 226.

Arranged between the rails 220 is an accelerating device comprising a pair of arms 237 which are secured to a shaft 238 which is arranged to be rotated by means not shown. The peripheral speed of the arms where they engage a batch is greater than the speed of the batch as removed by the sets of pushers. The shaft is rotated at such a speed that the arms engage the batch 223 and accelerate it away from the set pushers 216*b* and into the open gripper 226. The peripheral speed of the arms 237, therefore, where they engage the batch, will be greater than the linear speed of the sets of pushers on the chains 210 and 213. The shaft 238 will be rotated in such a manner as not to interfere with the batches carried by the sets of combined pushing and supporting elements 217 but so as to accelerate each of the batches such as 221 and 223 into a gripper which will be presented to receive the batch at the position shown for the gripper 226.

The right-hand part of the drawing shows the successive positions of the batches carried by gripper 226 and of the pushers 216*c* to 216*f* and these successive positions are designated by the references 223*c* to 223*f*.

The acceleration of the batch 223 into the gripper 226 leaves the batch 223 clear of the set of pushers 216*b* and as shown for the batch 223*c* the batch has started to be turned about the shaft 229. The turning continues as shown for the batch 223*d* and until the turning is complete for the batch 223*c* at which time the turned batch is lying on the rails 224. One of the rails 224 has an extension 224*d* to help to "catch" and support the end of the batch 223*d* which is the lower end during turning.

Shortly after reaching the position 223*e*, the operating arm 235 on the gripper engages a further cam 239 and this causes the gripper to open thus depositing the batch 223*f* on the rails 224. The set of pushers 216*f* catch up with the batch 226*f* and move it along the rails 224.

The batch will be moved off the end of the rails by the set of pushers which will then return to the left-hand ends of the chains 210 to 213 to pick up another batch of signatures from the collating unit 221. There will be another collating unit (not shown) at the right-hand end of the apparatus which will collate in pairs the batches such as 223*c* to 223*f* which have been turned and the batches such as 222 which have not been turned but which will be delivered from the right-hand ends of the rails 224 by the sets of combined pushers and supporting elements 217.

As the grippers return to the left-hand ends of the chain runs 200, the rollers 232 will engage the cam 234 and the grippers will be returned to their original positions with the operating arms 235 extending downwardly so that the grippers can be opened by the cam 236 at the left-hand end of the chain runs 200.

It is to be noted that in all the embodiments described the turned and unturned batches of signatures are transported in a single stream and this arrangement is very convenient and compact. It is to be noted also that in the embodiment of FIG. 6 the batches which are turned are turned about a horizontal axis which is parallel to the planes of the leaves, and to the junction between the two pages on each leaf, and is also parallel to the direction of conveying movement of the batches.

I claim:

1. A method of making a book from batches of leaves of paper each having printed thereon two pages meeting in a junction, said method including the steps of conveying the batches one behind the other in a single stream, moving each of selected ones of said batches and an open gripper for the batch at the same speed, in the same direction and along the same path with the gripper in front of the batch and open, accelerating the batch so that it enters the gripper, closing the gripper to grip the batch, and while the batch is being conveyed turning the gripper to turn the batch through 180°, while it is gripped, about an axis parallel to the junctions between the pages, and then releasing the turned batch from the gripper.

2. A method according to claim 1 wherein said selected ones comprise said batches occupying alternate positions in said stream, and turned and unturned batches are combined in pairs to form blocks for a double book or double book section.

3. A method of making a book from batches of leaves of paper each having two pages printed thereon meeting in a junction, the method including the steps of conveying said batches in a single stream in spaced relation, one behind the other, and at the same speed, moving into selected ones of the spaces between the batches grippers therefor, the grippers moving at the same speed, in the same direction and along the same path as the batches, accelerating each of said batches which is immediately behind a gripper so that the batch enters the gripper which is held open, closing each gripper when a batch has entered it, and while the batch is being conveyed, turning the gripper to turn the batch through 180° when it is gripped about an axis parallel to the junctions between the pages of the batch and then releasing the turned batch from the gripper.

4. A method according to claim 3 wherein each alternate batch of the stream is gripped and turned.

5. A method of assembling a block for a double book or double book section in a 2-up coming and going method of bookmaking in which successive lengths of a paper web have each been identically printed so that each length shows in total a number of primary book pages each of which appears once only, the method of assembling comprising (1) providing a plurality of identical batches of signatures, each batch consisting of leaves of paper formed by cutting and slitting one of said lengths and containing all of said primary pages arranged in pairs on the leaves with each pair of pages meeting in a junction; (2) conveying the batches in a single stream one behind the other towards a combining station; (3) while the batches are being so conveyed turning each alternate batch of the stream through 180° about an axis parallel to the junctions of the pages in the batch; and (4) assembling the batches at the combining station in pairs to form blocks for a double book or a double book section, each such pair comprising a batch which has been turned and a batch which has not been turned.

6. Apparatus for conveying and turning batches of leaves of paper, comprising first conveying means for conveying said batches in a single stream in spaced relation one behind the other, second conveying means carrying grippers for the batches, means co-relating the actions of the first and second conveying means so that the grippers enter selected ones of the spaces between at least some of the adjacent pairs of batches as the latter are moved by the first conveying means, the grippers being moved at the same speed and in the same direction as the batches, means for accelerating those selected ones of the batches which lie immediately behind the grippers into engagement with the grippers, means for opening and closing the grippers and arranged to operate so that the grippers are open when the batches are accelerated into engagement with the grippers and are then closed to grip the engaged selected ones of the batches respectively, means for turning the grippers while the selected one of the batches are gripped respectively by the grippers and as the grippers are moved by the second conveying means, and means to open the grippers to release the turned batches.

7. Apparatus according to claim 6 wherein the first conveying means includes a pair of spaced chains, a support for the batches and means on the chains to move the batches along the support.

8. Apparatus according to claim 6 wherein the means for accelerating the batches is a rotary device to engage the batches which are to be accelerated and means to rotate the device such that the peripheral speed of the device is, at the zone of engagement with the batches, greater than the speed at which the batches are being moved by the first conveying means.

9. Apparatus according to claim 7 wherein the chains of the first conveying means carry pushers for the batches to be turned, these pushers moving the batches along the support until the batches are received into the grippers.

10. Apparatus according to claim 9 wherein the chains of the first conveying means carry combined pushers and supporting elements for the batches which will not be turned.

11. Apparatus according to claim 7 wherein the second conveying means include a pair of spaced chains with cross members which carry the grippers, the chain runs of the second conveying means being arranged above, and parallel to, the chain runs of the first conveying means.

12. Apparatus according to claim 11 including first co-operating cam means on the grippers and on a fixed part of the apparatus to open and close the grippers as the gripper-carrying chains are moved and to turn the grippers in one direction as they move along one of the chain runs of the second conveying means and to turn the grippers in the opposite direction when they move along the other run of the second conveying means.

13. A method of making a book comprising the steps of:

a. providing batches of leaves in which the leaves collectively lie face to face, and in which in each of said batches the leaves are printed on both sides with pages of the book so selected that, viewed towards one terminal leaf of each batch, the latter presents one set of consecutively numbered face to face pages in coming sequence with the highest numbered page on the exposed side of said one terminal leaf and another set of consecutively numbered face to face pages in going sequence with the lowest numbered page on said exposed side of said one terminal leaf, the exposed side of the other terminal leaf of the batch bearing pages having those consecutive intermediate numbers which are appropriate to the number of leaves in the batch, b. conveying said batches in succession in a single stream with all of said one terminal leaves facing towards one boundary of the stream and all in the same orientation as regards the positions of corresponding pages relative to the direction of conveyance, and all of said one terminal leaves facing towards the opposite boundary of the stream, c. applying turning movement to selected ones of said batches relatively to the non-selected batches while in said single stream to cause each of said selected ones of said batches to occupy respective positions displaced angularly about an axis parallel to the leaves and junctions between pages thereon such that their one terminal leaves face towards said opposite boundary and their outer terminal leaves face towards said other boundary, d. brining pairs of said batches, one from the selected ones of said batches and one from the non-selected ones of said batches, into relative positions such that said other terminal leaves are in adjacent relation to each other, and the going sequence of each batch of the pair is opposite to the coming sequence of the other batch of the pair to provide sets of pages respectively in coming and going sequence and terminating, for each set, in pages having said highest and lowest numbers.

14. A method according to claim 13 wherein:

a. said selected ones of said batches initially occupy alternate positions longitudinally of said stream, b. said moving of said selected ones of said batches is effected by applying gripping opposing forces inwardly against the exposed sides of said terminal leaves of each of said selected ones and angularly moving the gripping forces through 180° about an axis extending longitudinally of said stream while maintaining the gripping forces in opposition to each other.

15. Apparatus according to claim 6 wherein:

a. said means correlating the actions of said first and second conveying means cause said grippers to enter alternate ones of the spaces between successive ones of the batches, b. means are provided defining a combining station to which the batches are delivered, c. means are provided at the combining station to assemble each of the turned batches with one of the unturned batches to form a block in which the terminal leaves of the block were those, in the respective batches, which before said turning, face towards opposite boundaries of said stream.

* * * * *

UNITED STATES PATENT AND TRADEMARK OFFICE

CERTIFICATE OF CORRECTION

PATENT NO. : 4,155,133

DATED : May 22, 1979

INVENTOR(S) : Ernest A. Timson

It is certified that error appears in the above-identified patent and that said Letters Patent are hereby corrected as shown below:

Column 7, line 9, after the word "two" insert --complete--.

Column 9, line 6, after the word "position" insert --occupied by the batch--.

Claim 13, line 33, delete the word "other" and substitute --one--.

Signed and Sealed this

*Eleventh* Day of *December 1979*

[SEAL]

*Attest:*

SIDNEY A. DIAMOND

*Attesting Officer*

*Commissioner of Patents and Trademarks*